US006787737B2

(12) United States Patent
Uekawa et al.

(10) Patent No.: US 6,787,737 B2
(45) **Date of Patent: *Sep. 7, 2004**

(54) HEATER HAVING IMIDE-BASED SLIDE LAYER AND IMAGE HEATING APPARATUS USING THE HEATER

(75) Inventors: Eiji Uekawa, Shizuoka (JP); Akihito Kanamori, Shizuoka (JP); Satoru Izawa, Shizuoka (JP); Hiroshi Kataoka, Shizuoka (JP); Shinji Hashiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/214,585

(22) Filed: Aug. 9, 2002

(65) Prior Publication Data

US 2003/0042241 A1 Mar. 6, 2003

(30) Foreign Application Priority Data

Aug. 10, 2001 (JP) ..... 2001-244289
Jul. 29, 2002 (JP) ..... 2002-220211

(51) Int. Cl.[7] ..... G03G 15/20; H05B 3/16; H05B 3/28; H05B 3/32

(52) U.S. Cl. ..... 219/216; 219/543; 399/329; 399/333

(58) Field of Search ..... 219/216, 469, 219/521, 530, 540, 543; 399/328–333

(56) References Cited

U.S. PATENT DOCUMENTS

| | | | | | |
|---|---|---|---|---|---|
| 4,970,219 | A | | 11/1990 | Effland et al. | 514/339 |
| 5,149,941 | A | | 9/1992 | Hirabayashi et al. | 219/216 |
| 5,210,579 | A | | 5/1993 | Setoriyama et al. | 355/285 |
| 5,262,834 | A | * | 11/1993 | Kusaka et al. | 399/329 |
| 5,401,936 | A | | 3/1995 | Kusaka et al. | 219/216 |
| 5,525,775 | A | | 6/1996 | Setoriyama et al. | 219/216 |
| 5,860,051 | A | | 1/1999 | Goto et al. | 399/529 |
| 6,002,106 | A | | 12/1999 | Kataoka et al. | 219/216 |
| 6,031,215 | A | * | 2/2000 | Nanataki et al. | 399/330 |
| 6,201,945 | B1 | * | 3/2001 | Schlueter, Jr. et al. | 399/329 |
| 6,456,819 | B1 | * | 9/2002 | Abe et al. | 399/329 |
| 6,518,546 | B2 | * | 2/2003 | Otsuka et al. | 219/216 |
| 6,597,888 | B1 | * | 7/2003 | Abe et al. | 399/329 |
| 2003/0035667 | A1 | * | 2/2003 | Izawa et al. | 399/333 |

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 04-204980 | 7/1992 |
| JP | 6-5356 | 1/1994 |
| JP | 10-319753 | 12/1998 |
| JP | 11-102133 | 4/1999 |

* cited by examiner

*Primary Examiner*—Joseph M Pelham
(74) *Attorney, Agent, or Firm*—Fitzpatrick, Cella, Harper & Scinto

(57) ABSTRACT

A heater has a top-surface layer made of an imide-based resin formed on an electrical insulation layer. The heater can generally used for an image heating apparatus incorporated in an image forming apparatus. Since the top-surface layer has preferable sliding and insulating characteristics, the heater provides good heat efficiency and durability.

38 Claims, 5 Drawing Sheets

BACK SURFACE SIDE

TOP SURFACE SIDE

CERAMIC HEATER
(BACK SURFACE)
(HEATING TYPE)

METALLIC HEATER
(TOP SURFACE HEATING TYPE)

METALLIC HEATER
(BACK SURFACE HEATING TYPE)

HEATER HAVING IMIDE-BASED SLIDE LAYER AND IMAGE HEATING APPARATUS USING THE HEATER

BACKGROUND OF THE INVENTION

1. Field of the Invention

The present invention relates to an image heating apparatus and a heater preferably used for a heating-fixing apparatus of an image forming apparatus such as a copying machine or a printer using an electrophotographic system or electrostatic recording system.

2. Related Background Art

Conventionally, in the case of an image forming apparatus using an electrophotographic system, the so-called heating-roller-type heating-fixing apparatus is widely used which heats and fixes a recording material carrying an unfixed toner image by passing the material through a nip portion formed by a fixing roller and pressure roller which are pressure-contacted with each other and rotated.

A halogen lamp set in the hollow metal core of a fixing roller is generally used as the heat source of a heating-roller-type heating-fixing apparatus in which the toner on the recording material is melted by using the heat transmitted from the inside of the core. It is necessary that the hollow core of the fixing roller has a wall thickness of 0.5 to 4.0 mm in order to have a sufficient mechanical strength and has a large heat capacity. Therefore, it is necessary to supply power to the halogen lamp even under a standby state and preheat the fixing roller.

Moreover, an on-demand film-heating-type heating-fixing apparatus is recently practically used to which power is not supplied for heating-fixing apparatus under a standby state to minimize the power consumption.

A film-heating-type heating apparatus is disclosed in the official gazettes of Japanese Patent Application Laid-Open No. 63-313182, Japanese Patent Application Laid-Open No. 2-157878, Japanese Patent Application Laid-Open No. 4-44075, and Japanese Patent Application Laid-Open No. 4-204980. A flat ceramic heater is generally used as the heat source of a film-heating-type. Heating and fixing are performed by setting a heat-resistant resin film (fixing film) between the ceramic heater and a pressure roller to form a pressure-contact nip and passing a recording material carrying an unfixed toner image between the fixing film and the pressure roller.

The above flat ceramic heater is disclosed in the official gazette of Japanese Patent Application Laid-Open No. 6-5356. The heater is obtained by forming a current-carrying exothermic resistance layer on one side of a flat slender high-insulating substrate made of alumina or aluminum nitride and the current-carrying exothermic resistance layer is protected by a glass film. A fixing film is used so as to slide with the protective glass film or so that the fixing film slides with a glass film by forming the glass film on the other side of the ceramic substrate. Therefore, the heat of the current-carrying exothermic resistance layer is transmitted to the fixing film through the glass film.

Various image forming apparatuses of printers and copying machines using the above film-heating-type heating-fixing apparatus have many advantages compared to a system for performing heating and fixing by using a conventional heating roller such as disuse of preheating under a standby state and decrease of wait time (on-demand fixing).

However, the conventional heating heater used to the above-described film-heating-type heating-fixing apparatus has the following problems.

That is, in the case of a heating-fixing apparatus, it is necessary to fix unfixed toner on a recording material in accordance with instantaneous heating than ever because operating speeds of copying machines and printers have been recently increased. However, the heat conduction of a heat-resistant resin film used as a fixing film for a conventional film-heating system does not have a heat conductivity enough to apply to high-speed printing.

Although it can be considered to raise the set temperature of a heater, it is not effective means because the set temperature of the heater is limited when considering heat-resistant temperatures of a resin used for a stay holder for holding a heater and other peripheral members.

To solve the above problems, it is possible to efficiently achieve heat conduction to a recording material by using a thin-wall metal sleeve having a high heat conductivity instead of a heat resistant resin as the base material of a fixing film as disclosed in the official gazette of Japanese Patent Application Laid-Open No. 10-319753. However, when using a conventional ceramic heater, a glass layer on the top surface of the heater scrapes against the inside of the metal sleeve. Even if a glass layer is not formed, the ceramic top surface scrapes against the inside of the metal sleeve. In any case, because the friction resistance between the metal of the sleeve and the glass top surface of the heater or ceramic top surface is large, the drive torque increases. If this state is continued, shaving of the inside of the metal sleeve advances and the drive torque further increases, and the metal sleeve serving as a fixing film may not be able to rotate or the metal sleeve may be broken. Moreover, the contact heat resistance between the heater and the metal sleeve is increased due to shaving powder and the heat efficiency may be deteriorated. Furthermore, it is necessary to secure the electrically insulating characteristic of the heater.

SUMMARY OF THE INVENTION

The present invention is made to solve the above problems and its object is to provide a heater having a preferable sliding characteristic against a rotator and an image heating apparatus using the heater.

It is another object of the present invention to provide a heater securing an insulating characteristic and an image heating apparatus using the heater.

It is further object of the present invention to provide an image heating apparatus comprising, a heater for heating an image on a recording material, which has a substrate and a heat generating resistor provided on the first plane of the substrate, a rotator which rotates while contacting with the second plane opposite to the first plane of the heater and has a metallic layer, wherein an imide-based slide layer is formed on the second plane of the heater.

It is further object of the present invention to provide a heater comprising, a substrate, a heat generating resistor, and a top-surface layer made of an imide-based resin provided on the plane opposite to the plane on which the heat generating resistor is provided.

It is still further object of the present invention to provide an image heating apparatus, comprising, a heater for heating an image on a recording material, which has a substrate and a heat-generating resistor provided for the substrate, a rotator rotating while contacting with the plane for which the heat generating resistor of the heater is provided and having a metallic layer, wherein an electrically insulating layer is formed on the heat generating resistor and an imide-based slide layer is formed on the electrically insulating layer.

It is still further object of the present invention to provide a heater comprising, a substrate, a heat generating resistor, an electrically insulating layer formed on the heat generating resistor, and a top-surface layer made of an imide-based resin formed on the electrically insulating layer.

Other objects of the present invention will become more apparent from the detailed description by referring to the accompanying drawings.

DESCRIPTION OF THE PREFERRED EMBODIMENTS

First Embodiment (1) Image Forming Apparatus

Figure 1:
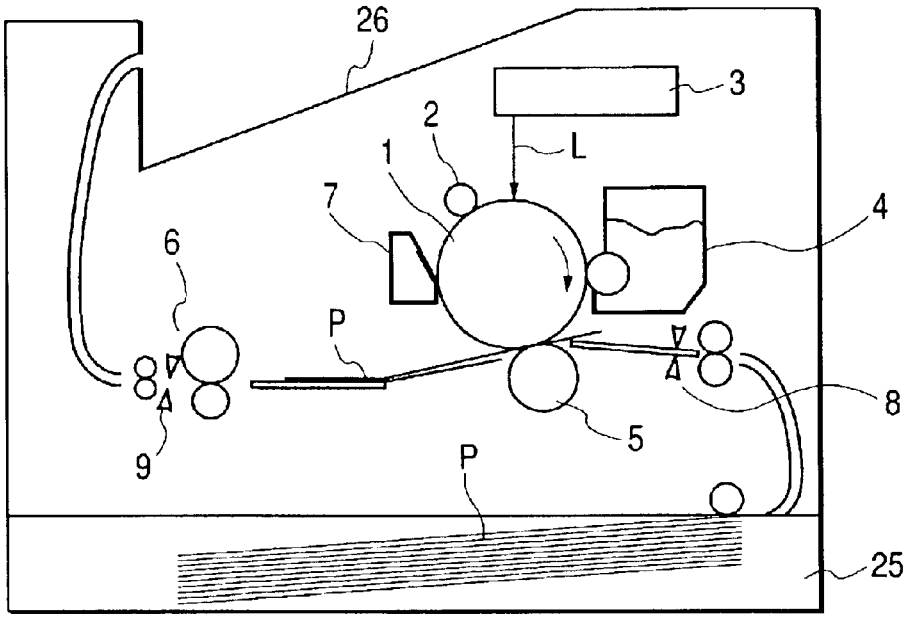
FIG. 1 is a schematic sectional view of an electrophotographic printer mounting an image heating apparatus of the present invention.

FIG. 1 is a schematic block diagram of the image forming apparatus of this embodiment.

Numeral 1 denotes a photosensitive drum in which a photosensitive material such as OPC, amorphous Se, or amorphous Si is formed on a cylindrical substrate made of aluminum or nickel.

The photosensitive drum 1 is rotated in the direction of the arrow and its top surface is uniformly electrified by an electrification roller 2 serving as an electrifying apparatus.

Then, a scanning exposure is performed by a laser beam L on/off-controlled by a laser scanner 3 in accordance with image information so that an electrostatic latent image is formed.

The electrostatic latent image is developed and visualized by a developing apparatus 4. As a developing method, it is used, the jumping developing method, two-component developing method, or FEED developing method. Image exposure and a reverse image are frequently used by combining them.

A visualized toner image is transferred onto a recording material P conveyed from a sheet-feed cassette 25 to a transferring-nip portion serving as a pressure contact portion between a transfer roller 5 serving as a transferring apparatus and the photosensitive drum 1 at a determined timing from the surface of the photosensitive drum 1.

The front end of a recording material fed from the sheet-feed cassette 31 is detected by a top sensor 8 to adjust timing so that the image forming position of a toner image on the photosensitive drum 1 coincides with the write start position of the front end of the recording material. The recording material P conveyed to the transferring-nip portion at a predetermined timing is held by the photosensitive drum 1 and transferring roller 5 at a constant pressure and conveyed.

The recording material P to which the toner image is transferred is conveyed to a heating-fixing apparatus 6, fixed as a permanent image, and discharged onto a discharge tray 32.

The remaining toner of transfer left on the photosensitive drum 1 is removed from the surface of the photosensitive drum 1 by a cleaner 7.

Moreover, numeral 9 denotes a discharge sensor set in the heating-fixing apparatus 6 for detecting a paper jam caused between a top sensor 8 and a discharge sensor 9.

(2) Heating-fixing Apparatus 6

Figure 2:
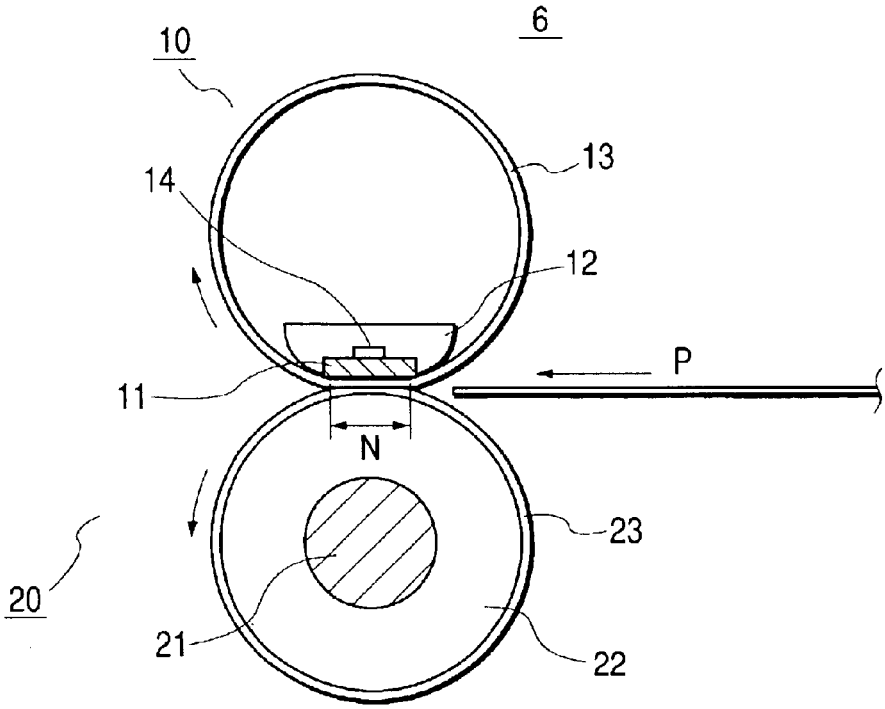
FIG. 2 is a schematic sectional view of an image heating apparatus of the present invention.

FIG. 2 is a schematic block diagram of the heating-fixing apparatus 6. The heating-fixing apparatus 6 is a film-heating-type heating-fixing apparatus constituted by a fixing member (assembly) 10 and a pressure member 20 which are basically pressure-contacted with each other to form a fixing-nip portion N and uses a metal sleeve as a fixing film (heating-fixing rotator).

1) Fixing Member 10

The fixing member 10 is constituted by the following members.

Numeral 13 denotes a metal sleeve having a small heat capacity used as a fixing film. The metal sleeve is formed by using a pure metal such as steel use stainless (SUS), Mg, Al, Ni, Cu, Zn, or Ti or an alloy having the total thickness of 200 $\mu$m or less and having heat resistance and high heat conductivity as a base layer in order to realize quick start.

The total thickness of 30 $\mu$m or more is necessary as a metal sleeve having a sufficient strength and superior in durability. Therefore, it is optimum that a metal sleeve has a total thickness between 30 and 200 $\mu$m (both included).

A mold-release layer is formed on the surface layer of a metal sleeve in order to prevent an offset or secure the separation characteristic of a recording material by covering it with any one of or a mixture of heat-resistant resins respectively having a preferable mold-release characteristic such as fluororesins and silicone resins including polytetrafluoroethylene (PTFE), tetrafluoroethylene-perfluoroalkylvinylether copolymer (PFA), tetrafluoroethylene-hexafluoropropylene copolymer (FEP), ethylene-tetrafluoroethylene copolymer (ETFE), polychlorotrifluoroethylene (CTFE), and polyvinylidene fluoride (PVDF).

As a covering method, it is allowed to etch the outside of the metal sleeve 13 and then dip a mold release layer or coat the outside with a power spray. Moreover, it is allowed to cover the top surface of the metal sleeve 13 with a tubular resin. Furthermore, it is allowed to blast the outside of a metal sleeve and then apply a primer layer serving as an adhesive to the outside and cover the primer layer with a mold-release layer.

Numeral 11 denotes a heating heater set in the metal sleeve 13 to heat the fixing-nip portion N by contacting with the inside of the metal sleeve 13. The heating heater will be described later in detail.

Numeral 12 denotes a heat-insulating stay holder for holding the heating heater 11 and preventing heat dissipation in the direction opposite to the fixing-nip portion N. The stay holder is formed by a resin superior in workability such as a liquid-crystal polymer, phenol resin, PPS, or PEEK.

2) Pressure Member 20

The pressure member 20 is an elastic roller constituted by an elastic layer 22 formed by expanding heat-resistant rubber such as silicon rubber or fluorocarbon rubber outside the metallic core 21 made of steel use stainless (SUS) steel use machinability (SUM), or Aluminum (Al). It is also allowed to form a mold-release layer 23 made of PFA, PTFE, or FEP on the member 20.

The pressure member 20 is sufficiently pressed by not-illustrated pressure means in the direction of the above fixing member 10 in order to form a fixing-nip portion necessary for heating and fixing from the longitudinal both ends. Moreover, the member 20 is rotated in the direction of the arrow by not-illustrated rotation driving through the core 21 from a longitudinal end. Thereby, the above metal sleeve 13 is rotated outside the stay holder 12 in the direction of the arrow in FIG. 2. Or, the metal sleeve 13 is rotated by setting a drive roller (not shown) in the metal sleeve 13 and rotating the drive roller.

The recording material P carrying an unfixed toner image is conveyed into the fixing-nip portion N formed by the heating member 10 and pressure member 20 and the unfixed toner is heated and fixed by receiving the heat supplied from the heating heater 11 through the metal sleeve 13 and the pressure by the pressure member 20.

The temperature of the heating heater 11 is detected by temperature detecting means 14 such as a thermistor set to the back surface of the heater, fed back to an electrification control section (not shown), and the heater 11 is temperature-controlled so that the heater temperature is kept at a constant value (fixing temperature).

Moreover, a lubricant such as heat-resistant grease is applied between the heating heater 11 and metal sleeve 13 in order to improve the sliding characteristic. Mainly, fluorine-based grease and silicone-based grease are suitable because these greases are superior in heat resistance.

(3) Heating Heater 11

Figure 3A:
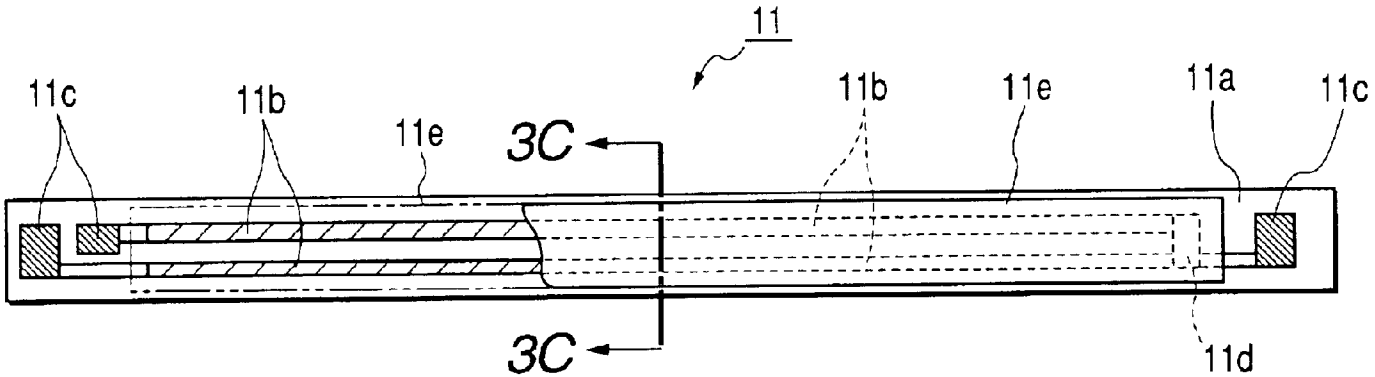
FIGS. 3A, 3B, and 3C respectively show a back-surface view, top-surface view, and sectional view of a heater (back-surface-heating-type ceramic heater) of first embodiment.
Figure 3B:
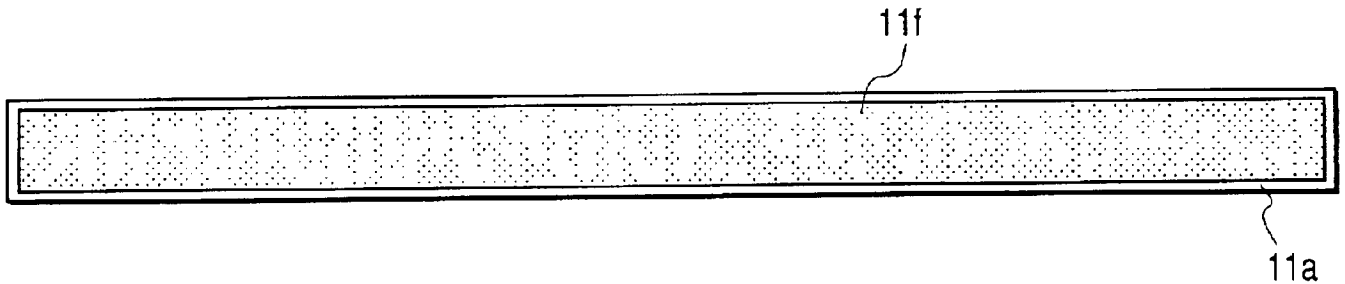
Figure 3C:
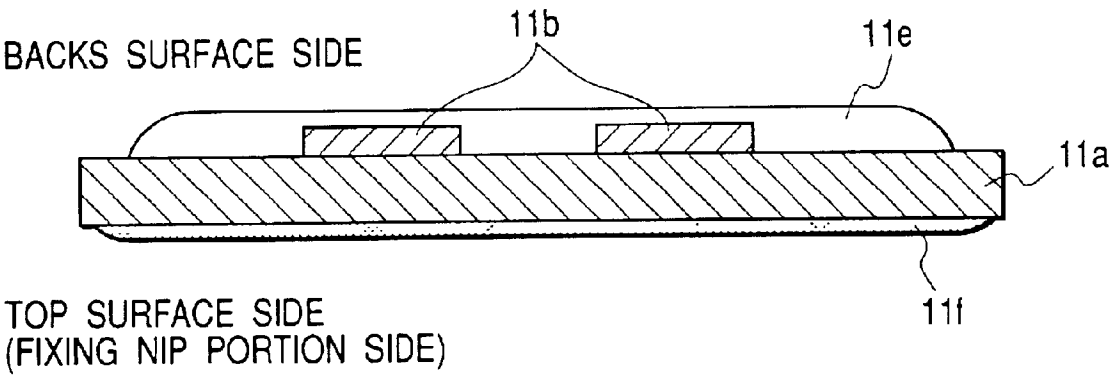

FIGS. 3A, 3B, and 3C show the heating heater 11 of this embodiment, in which FIG. 3A is a locally-cut-out top view of the heater 11 viewed from the electrification-exothermic-resistance-layer-forming-plane (first plane) side, FIG. 3B is a top view of the heater 11 viewed from the plane (second plane) side opposite to the electrification-exothermic-resistance-layer-forming-plane side, and FIG. 3C is an enlarged sectional view of FIG. 3A. The heating heater 11 of this embodiment is a ceramic heater using a ceramic material as a heater substrate.

Numeral 11*a* denotes a ceramic substrate made of ceramic such as alumina or aluminum nitride having a high heat conductivity and insulating characteristic. It is proper that the ceramic substrate 11*a* has a thickness of approx. 0.5 to 1.0 mm in order to decrease the heat capacity and is formed into a rectangle having a width of approx. 10 mm and a length of approx. 300 mm.

An electrification exothermic resistance layer 11*b* is formed on one plane (first plane) of the ceramic substrate 11*a* with the longitudinal direction of the substrate 11*a*. The electrification exothermic resistance layer 11*b* mainly contains Ag/Pd (sliver-palladium) alloy, Ni/Sn (nickel-tin) alloy, or $RuO_2$ (ruthenium oxide) alloy, which is formed like a line or thin band having a thickness of approx. 10 $\mu$m and a width of 1 to 5 mm through screen printing and then, baked and molded. As a pattern shape, it is allowed to use a pattern obtained by folding back two electrification exothermic resistance layer 11*b* as shown in FIG. 3A, a pattern having one electrification exothermic resistance layer in the longitudinal direction, or a pattern having a plurality of electrification exothermic resistance layer together in parallel.

Numeral 11*c* denotes a power-supply electrode portion for supplying power to the electrification exothermic resistance layer 11*b* and 11*d* denotes a conducting pattern for connecting the power-supply electrode portion with the electrification exothermic resistance layer 11*b*, and 11*c* and 11*d* are respectively formed by Ag or Ag/Pd (silver palladium).

The electrification exothermic resistance layer 11*b* is over-coated with an insulating glass layer 11*e*. The insulating glass layer 11*e* secures the insulating characteristic between the electrification exothermic resistance layer 11*b* and an external conductive member and has a corrosion-resistant function for preventing a resistance-value change due to oxidation of the electrification exothermic resistance layer 11*b* and a function for preventing a mechanical damage. It is preferable to set the thickness of the layer 11*e* to a value between 20 and 100 $\mu$m.

The heating heater 11 of this embodiment is the back-surface heating type, in which the side (first plane side) provided with the electrification exothermic resistance layer 11*b* of the ceramic substrate 11*a* of a heater substrate 11*a* serves as the back-surface side of the heater and the opposite side (second plane side) serves as the top-surface side of the heater. The top-surface side of the heater slides by facing and contacting with the inside of the metal sleeve 13.

Numeral 11*f* denotes a slide layer mainly containing imide-based resin such as polyimide or polyamide-imide resin formed on a ceramic substrate plane (second plane) sliding with the inside of the metal sleeve 13. The slide layer has a function superior in heat resistance, lubricating characteristic, and abrasion resistance and shows a smooth sliding motion with the metal sleeve 13.

The slide layer 11*f* is coated directly with varnishy polyimide or polyamide-imide or after properly diluting the polyimide or polyamide-imide with an organic solvent such as absolute N-methylpyrrolidone (NMP), N or N-dimethylacetamide through dipping coating or spray coating or mixed with an additive such as a thickener or leveling agent and then coated through screen printing. Moreover, an antifoamer or sizing agent is used as an additive. The layer 11 is coated and then molded in the drying step and baking step.

To satisfy functions necessary as the slide layer 11*f*, it is necessary to satisfy the following conditions in its forming step.

a) Thickness of Slide Layer 11*f*

It is preferable that a thickness of the slide layer 11*f* ranges between 3 and 10 $\mu$m (both included). That is, when the thickness of the slide layer 11*f* decreases, the ceramic substrate 11*a* is exposed due to the friction with the metal sleeve 13 during the durability test of a heating-fixing apparatus. When the ceramic substrate 11*a* is exposed, the frictional resistance against the metal sleeve 13 increases. Therefore, a drive torque increases and moreover, the inside of the metal sleeve is abraded.

For example, the thickness and drive torque of the slide layer 11*f* are examined after performing the durability test of feeding 200,000 sheets which is the service life of a heating-fixing apparatus on the layer 11*f* coated through screen printing by using heating heaters having different thicknesses of 2.0 to 5.0 $\mu$m. The metal sleeve 13 uses an SUS sleeve having a thickness of 40 $\mu$m. Table 1 shows the results.

TABLE 1

| | Durability change due to difference between slide-layer thickness | | |
|---|---|---|---|
| | Initial slide-layer thickness | Slide-layer thickness after feeding 200,000 sheets | Drive torque after feeding 200,000 sheets |
| <1> | 2.0 μm | 0.0 to 1.4 μm | 4.0 kg · cm |
| <2> | 3.0 μm | 1.6 to 2.6 μm | 3.0 kg · cm |
| <3> | 5.0 μm | 4.0 to 4.6 μm | 2.8 kg · cm |

wherein:

4.0 kg·cm≈39.2 N·cm 3.0 kg·cm≈29.4 N·cm 2.8 kg·cm≈27.4 N·cm

From the above results, it is found that a portion from which the ceramic substrate 11*a* is locally exposed is produced when the slide layer 11*f* has a small initial thickness of 2.0 μm and the drive torque of the pressure roller 20 increases. Therefore, it is preferable that the slide layer 11*f* has a thickness of 3 μm or more. Moreover, when the slide layer 11*f* is so thick, the thermal energy conveyed from the electrification exothermic resistance layer 11*b* to the metal sleeve 13 is cut off and an unfixed toner image is imperfectly fixed.

Table 2 shows results of comparing the top-surface temperature of the metal sleeve 13 with the fixing characteristic of a toner image after heating and fixing unfixed toner on a thick paper under the conditions when using the heating heaters 11 when the thickness of the slide layer 11*f* ranges between 5.0 and 15.0 μm and setting the temperature-control temperature of the heating heater 11 to 200° C. The fixing characteristic of the toner image is ranked as follows: symbol ○ in the table is applied when characters are rubbed by a finger and no character is erased and symbol x in the table is applied when any character is erased.

TABLE 2

| | Temperature on top surface of metal sleeve and fixing characteristic of image due to difference between slide-layer thickness | | |
|---|---|---|---|
| | Initial slide-layer thickness | Top-surface temperature of metal sleeve when keeping temperature at 200° C. | Fixing characteristic of toner image |
| <1> | 5.0 μm | 195° C. | ○ |
| <2> | 10.0 μm | 189° C. | ○ |
| <3> | 15.0 μm | 179° C. | x |

From the above results, it is found that when the slide layer 11*f* becomes thicker, the top-surface temperature of the metal sleeve 13 lowers and the fixing characteristic of the toner image is deteriorated. Therefore, it is preferable that the thickness of the slide layer 11*f* is 10 μm or less and the layer 11*f* is used at a thickness equal to or more than 3 and equal to or less than 10 μm (both included) when combining the results with the results in the above Table 1.

b) Heat Treatment Temperature After Coating Slide Layer

It is necessary to dry the polyimide slide layer 11*f* coated on the top surface of the ceramic substrate 11*a* at a temperature between 100° C. and 200° C (both included) for 30 minutes or more and then, completely bake the layer 11*f* at a temperature between 350° C. and 450° C. (both included) and complete a change-to-imide reaction by 90% or more.

Figure 4:
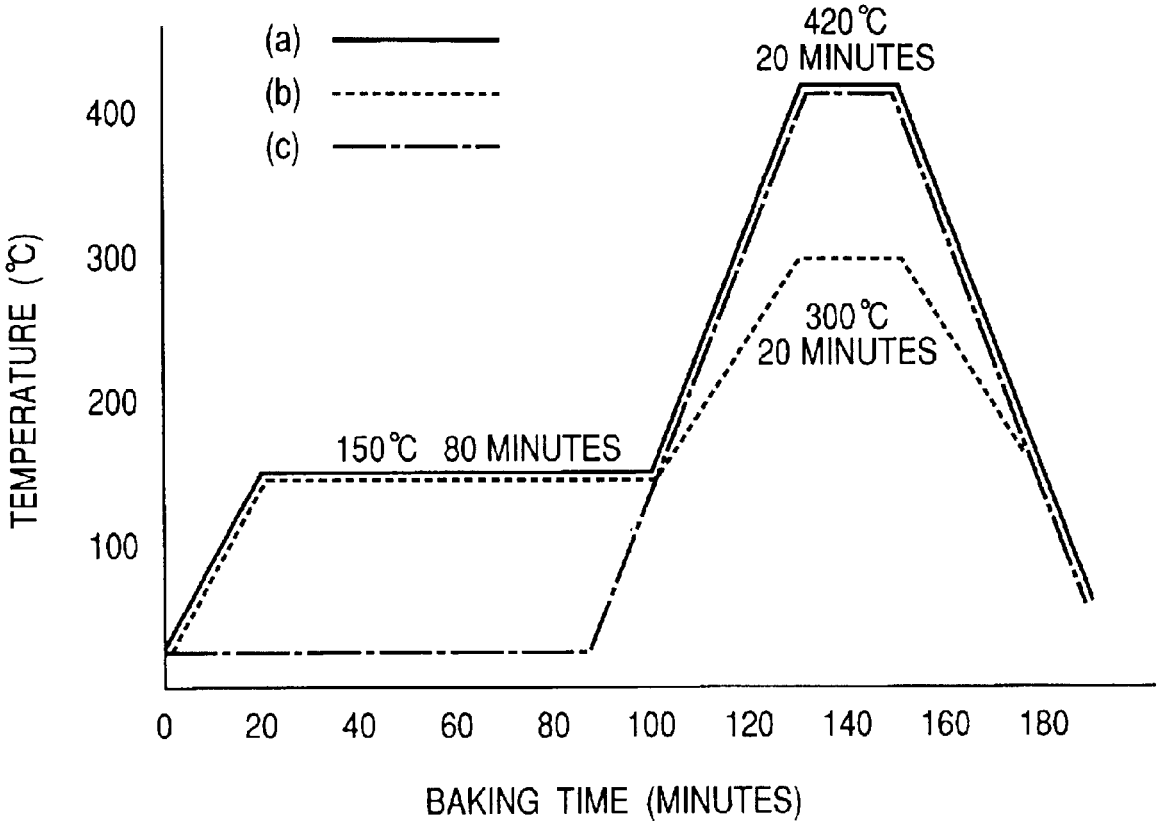
FIG. 4 is a graph showing a baking pattern of a slide layer.

In the case of this embodiment, a polyimide slide layer is obtained through the baking step shown by the line (a) in FIG. 4 by using the polyimide varnish (trade name: U-Varnish, Type S; for high heat resistance) made by Ube Industries, Ltd. This baking condition follows a pattern adjusted so as to be suited for conditions of the output and size of a baking furnace used for this embodiment in accordance with the baking pattern recommended by Ube Industries, Ltd.

For comparison with the above results, an abrasion test is applied to a slide layer by preparing a heating heater using a low temperature of 300° C. as the complete baking temperature after drying and baking and a heating heater performing complete baking at a temperature of 430° C. without passing through the drying step shown by the line (c) in FIG. 4 and using heating heaters (a), (b), and (c).

As a test method, feeding of 200,000 sheets which is the service life of a heating-fixing apparatus is performed by using an image forming apparatus to compare thicknesses and appearances of slide layers. Initial thicknesses of slide layers are all set to 5.0 μm. Table 3 shows the results.

TABLE 3

| | Change of slide layer after endured due to difference between baking conditions | |
|---|---|---|
| Baking condition | Slide-layer thickness after feeding 200,000 sheets | Appearance of slide layer after feeding 200,000 sheets |
| (a) Drying + 430° C. baking | 4.0 to 4.6 μm | There is no problem. |
| (b) Drying + 300° C. baking | 0.0 to 2.5 μm | Many base-layer exposed portions are found. |
| (c) Only 430° C. baking | 0.0 to 3.0 μm | Base-layer exposure and thickness irregularity are found. |

From the above results, it is found that in the case of (b) in which the baking temperature after drying is low, the base layer after the durability test is extremely exposed and greatly shaved. This is probably because baking is insufficient and thereby the change-to-imide of polyimide is not completely progressed, and thus a sufficient abrasion resistance is not obtained.

Moreover, in the case of (c) in which drying is not performed, thickness irregularity of a slide layer is observed before the durability test and as a result of performing the durability test, the exfoliation of the slide layer is observed at a thin portion. This is probably because drying is not performed and thereby N-methylpyrrolidone (NMP) diluting polyimide varnish is suddenly evaporated and thickness irregularity occurs or the adhesiveness is deteriorated.

Therefore, when using polyimide as the slide layer 11*f*, a drying step and change-to-imide baking at a high temperature are necessary.

Moreover, there may be a case in which it is enough that the change-to-imide baking temperature is lower than the case of this embodiment depending on the type of the polyimide used and the output and size of a baking furnace are also influenced. Therefore, the baking step is not restricted to the above baking pattern.

Furthermore, when using polyamide-imide as the slide layer 11*f*, a complete baking temperature of approx. 300° C. is proper because heat decomposition occurs at a high temperature.

c) Substrate Treatment Before Slide-layer Coating

To improve the adhesiveness between the slide layer 11*f* and ceramic substrate 11*a*, it is effective to apply pretreatment to the top surface of the ceramic substrate 11*a* before coating the slide layer 11*f*.

Top-surface polishing by sandpaper is one of the methods. More specifically, the adhesive strength of a polyimide film to a substrate is increased by the anchor effect and the adhesiveness is improved by polishing the coating plane of the film by sandpaper of approx. #1200, removing grease and the like from the top surface of the film, and forming fine scratches on the top surface of the film.

Moreover, it is possible to obtain the same effect by blasting the top surface.

Furthermore, it is effective to execute coupling treatment as another method of substrate pretreatment. More specifically, the top surface of a ceramic substrate is dried after spraying a silane-based coupling agent such as methyltriethoxysilane or ethyltriethoxysilane or titanium-based coupling agent such as tetraisopropoxy titanium or tetrastearoxy titanium on the top surface of the ceramic substrate.

Furthermore, it is allowed to activate the top surface of the substrate by applying corona discharge to the top surface before spraying a coupling agent.

Furthermore, the same effect can be obtained by adding approx. 5 parts by weight of a coupling agent into the polyimide varnish that is the material of the slide layer 11*f* instead of applying a coupling agent.

Results of comparing adhesivenesses of the slide layer 11*f* to which a slide durability test is applied about (a) a heating heater polished by sandpaper, (b) a heating heater pretreated by a silane coupling agent, and (c) a heating heater directly coated with a slide layer with no pretreatment are shown below. In the case of the test, thicknesses and appearances of a slide layer after a durability test are compared by using an image forming apparatus similarly to the above case and thereby performing the feed of 200,000 sheets which is the service life of a heating-fixing apparatus. Table 4 shows the results.

TABLE 4

| | Change of substrate due to difference between preprocessings after endured | |
|---|---|---|
| Preprocessing condition | Slide-layer thickness after feeding 200,000 sheets | Appearance of slide layer after feeding 200,000 sheets |
| (a) Paper polishing | 4.0 to 4.6 μm | There is no problem. |
| (b) Coupling | 3.9 to 4.4 μm | There is no problem. |
| (c) No preprocessing | 0.0 to 2.6 μm | Many slide-layer exfoliated portions are found. |

From the above results, it is found that polishing by sandpaper and coupling treatment improves the adhesiveness between the slide layer 11*f* and substrate 11*a*. Moreover, it is considered that methods such as degreasing and chemical polishing are effective for improvement of adhesiveness of the slide layer 11*f* in addition to the above method.

In the case of the heating heater 11 of this embodiment, as shown in FIGS. 3A to 3C, the slide layer 11*f* is formed on the opposite side to the electrification exothermic resistance layer 11*b* of the ceramic substrate 11*a* to slide the heater with the metal sleeve 13 as the back-surface heating type. However, as shown in FIG. 5, it is also possible to coat the insulating glass layer 11*e* formed on the electrification exothermic resistance layer 11*b* with the slide layer 11*f* so that the electrification exothermic resistance layer 11*b* is brought to the fixing-nip-portion face side as the top-surface heating type.

In this case, the insulating glass layer 11*e* must have a thickness of 30 μm or more because it is necessary to completely secure insulating characteristics of the electrification exothermic resistance layer 11*b* and metal sleeve 13 even if the slide layer 11*f* is abraded. However, if the layer 11*e* is so thick, the heat conductivity to the metal sleeve 13 is deteriorated. Therefore, a thickness of 100 μm or less is proper. Moreover, manufacturing conditions for forming the slide layer 11*f* are the same as described above.

Figure 5:
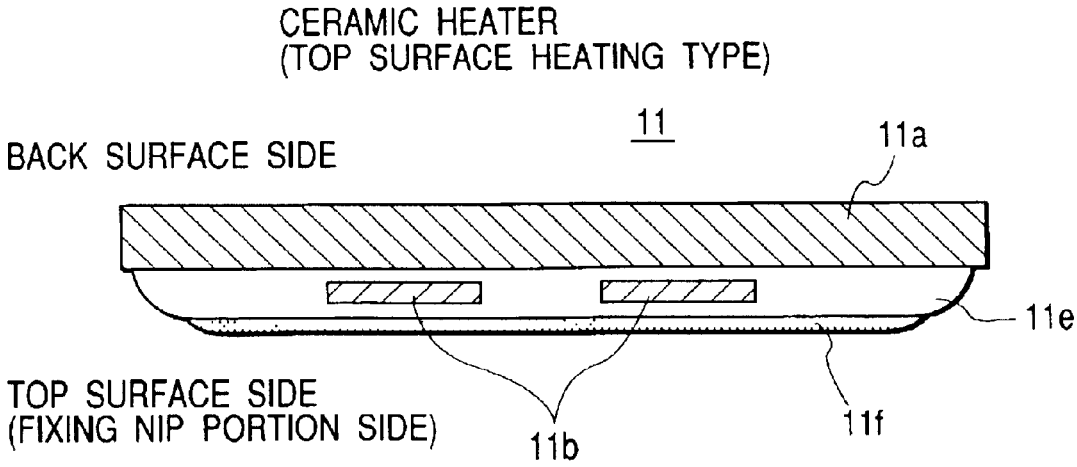
FIG. 5 is a sectional view of a heater (top-surface-heating-type ceramic heater) of the first embodiment.

When using alumina for the ceramic substrate 11*a*, there is an advantage that the top-surface heating type in FIG. 5 is superior to the back-surface heating type in FIGS. 3A to 3C in heat conduction efficiency. That is, in comparison between heat conductivities, alumina is superior to glass. However, to generally increase the strength of the heating heater 11, alumina substrate 11*a* has a thickness of 0.5 to 1.0 mm. However, because the glass coat 11*e* has a thickness of 30 to 100 μm, in comparison between heat resistances considering heat capacities, a configuration more superior in heat conductivity is obtained by forming the electrification exothermic resistance layer 11*b* on the top surface of the ceramic substrate 11*a* as shown in FIG. 5.

As described above, by forming an imide-based slide layer (top-surface layer) on an insulating substrate in the case of the back-surface heating type or forming an imide-based slide layer (top-surface layer) on an insulating substrate through an insulating layer in the case of the top-surface heating type, it is possible to improve the sliding characteristic against the metal sleeve 13 while securing the electrically insulating characteristic.

Second Embodiment

Second embodiment of the present invention is described below. Because the configuration of the whole heating-fixing apparatus of this embodiment is the same as that in FIG. 2 shown for the above described embodiment 1, its description is omitted.

Figure 6:
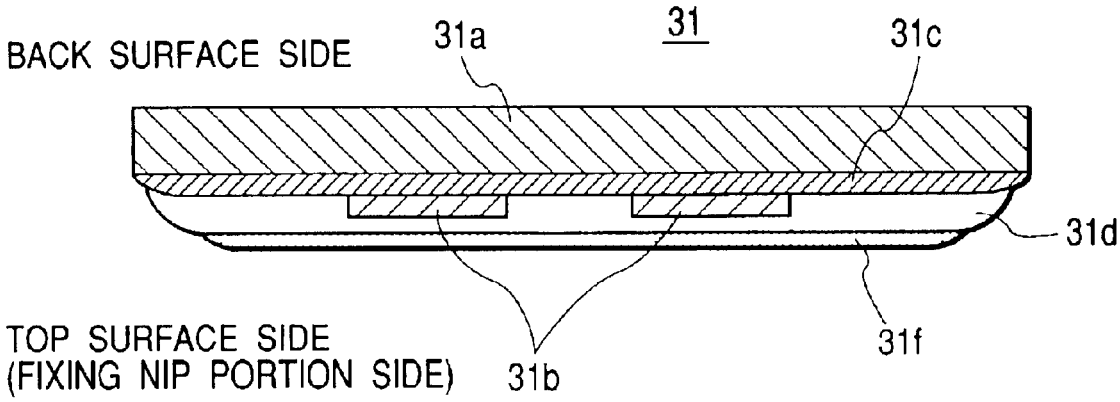
FIG. 6 is a sectional view of a heater (top-surface-heating-type metallic heater) of second embodiment.

FIG. 6 shows a sectional view of a heating heater representing this embodiment. The heating heater 31 uses a conductive material such as a metal instead of an insulting material such as ceramic as the heater substrate. The substrate of this embodiment is made of a metal and formed by a high-conductive metallic substrate 31*a* which is a metallic flat plate, an insulating glass layer 31*c* serving as a first insulating layer formed on one side of the metallic substrate 31*a*, an electrification exothermic resistance layer 31*b* formed on the insulating layer, an insulating glass layer 31*d* serving as a second insulating layer formed on the layer 31*b* so as to cover the electrification exothermic resistance layer 31*b*, and a slide layer 31*f* formed on the second insulating layer 31*d* in order to improve the sliding characteristic against the metal sleeve 13.

The metallic substrate 31*a* can use a metal such as iron, copper, aluminum, or zinc or an alloy such as SUS superior in rust preventive characteristic. More preferably, however, by using an alloy such as SUS 430 having a linear expansion coefficient as close to that of the insulating glass layer 31*c* as possible, it is possible to prevent a warpage or crack due to expansion under baking.

It is necessary to decrease the heat capacity of the metallic substrate 31*a* similarly to the case of the ceramic substrate 11*a* of the heating heater 11 of the above first embodiment in order to obtain the quick start characteristic of the heating heater 31 and moreover, it is proper that the substrate 31*a* has a thickness of 0.5 to 1.0 mm in order to meet the strength of the substrate. The width of the substrate 31*a* is formed into a rectangle having a width of approx. 10 mm and a length of approx. 300 mm so as to be able to cover a heating-nip width.

The insulating glass layer 31*c* serving as a fist insulating layer is formed on almost the entire region of one side of the metallic substrate 31*a*. The layer 31*c* is mainly made of glass and ceramic paint and formed by being coated in accordance with a method such as screen printing and baked. It is preferable that the insulating glass layer 31*c* is formed at a thickness of 30 to 100 μm in order to have a withstand voltage of 1.5 kV or higher and printed several times in order to prevent pinholes.

The electrification exothermic resistance layer 31*b* is formed by painting an Ag/Pd alloy or the like on the layer through screen printing and baking it. Because the layer 31*b* is the same as that of the embodiment 1, its detailed description is omitted.

The second insulating glass layer 31*d* is formed to secure the insulating characteristic between the electrification exothermic resistance layer 31*b* and external conductive member and has a thickness of 30 to 100 μm.

The slide layer 31*f* formed on the second insulating glass layer 31*d* is a layer having a thickness of 3 to 10 μm made of an imide-based resin such as polyimide or polyamide-imide the same as the case of the first embodiment. The painting method, baking temperature, and pretreatment are the same as the case of the embodiment 1, their description is omitted.

Thus, by using a metallic substrate having a high heat conductivity for the material of the heater substrate of the heating heater 31, it is possible to uniform a heater temperature over the whole region. Moreover, because it is possible to easily prevent temperatures at the both longitudinal ends from lowering, it is possible to form a preferable image free from image irregularity such as fixing irregularity or luster irregularity.

Moreover, because the break strength of a metallic substrate is very high compared to that of ceramic and the like, the substrate is not broken due to the heat stress caused when the temperature of a heater suddenly rises and moreover, because a substrate can be prevented from cracking in the manufacturing process, it is possible to improve the productivity.

Figure 7:
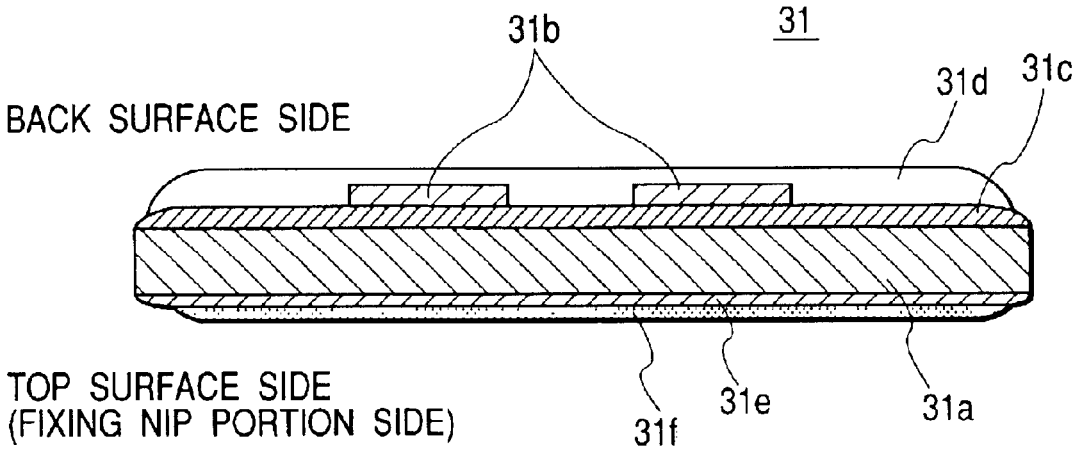
FIG. 7 is a sectional view of a heater (back-surface-heating-type metallic heater) of the second embodiment.

Furthermore, as shown in FIG. 7, it is allowed to realize a configuration in which the slide layer 31*f* is formed on the face opposite to the electrification exothermic resistance layer 31*d* of the metallic substrate 31*a* to slide the face with the metal sleeve 13. In this case, if the slide layer 31*f* is shaved due to the friction against the metal sleeve and the metallic substrate 31*a* is even slightly exposed, it is impossible to keep the insulating characteristic between the metal sleeve 13 and metallic substrate 31*a*. In the case of a configuration of applying a bias to the metal sleeve 13 for preventing the offset of an image, a current leaks at the exposed portion. To prevent this problem, it is necessary to form a third insulating glass layer 31*e* between the slide layer 31*f* and metallic substrate 31*a*. However, because the heat by the electrification exothermic resistance layer 31*b* is conveyed to the metal sleeve 13 through four layers such as the first insulating glass layer 31*c*, metallic substrate 31*a*, third insulating glass layer 31*e*, and slide layer 31*f*, the heater shown in FIG. 6 is more preferable when considering a heat efficiency.

As described above, even when using a metallic substrate having a high heat conductivity as the heater substrate of the heating heater 31, it is possible to use the metallic substrate as the heating heater 31 of a heating-fixing apparatus using the metal sleeve 13 by forming the slide layer 31*f* on an insulating glass coat. Moreover, it is possible to uniform the temperature in the longitudinal direction compared to the case of a conventional ceramic substrate and the problem of break is improved.

Thus, even when using a conductive substrate, it is possible to improve the sliding characteristic with a metal sleeve with securing an electrically insulating characteristic by constituting the substrate like the case of this embodiment.

Third Embodiment

Then, third embodiment of the present invention is described below by referring to FIGS. 8A to 8C.

This embodiment specifies a region for forming a slide layer made of an imide-based resin. The third embodiment is described by using an alumina substrate same as that of the first embodiment as a substrate. However, the substrate can be applied to the case of using the conductive substrate of the second embodiment. A member having the same function as the member described in the first embodiment is provided with the same symbol.

Figure 8A:
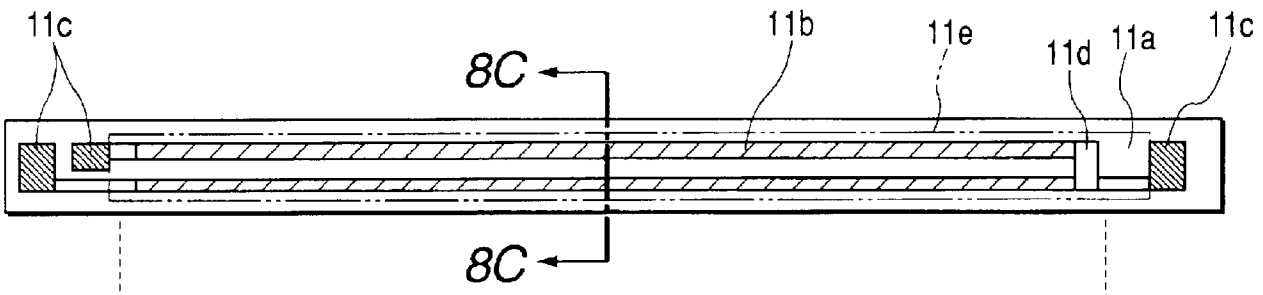
FIGS. 8A, 8B, and 8C respectively show a back-surface view, top-surface view, and sectional view of a heater (back-surface-heating-type ceramic heater) of third embodiment.
Figure 8B:
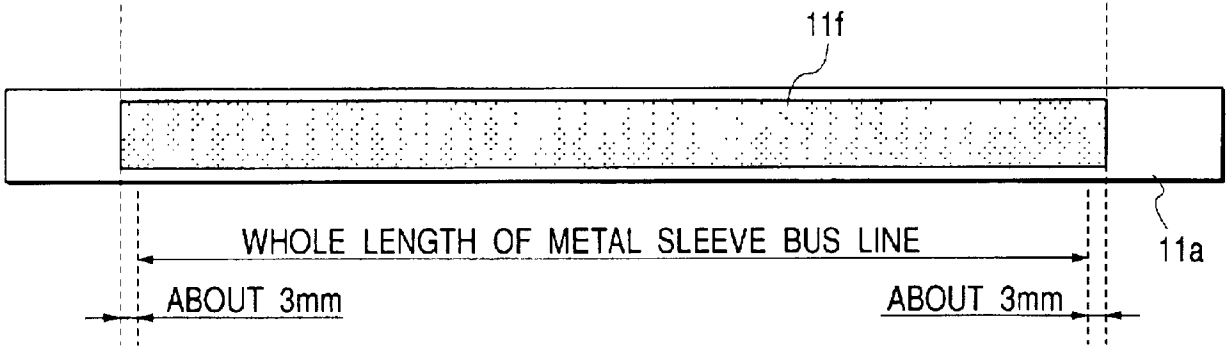
Figure 8C:
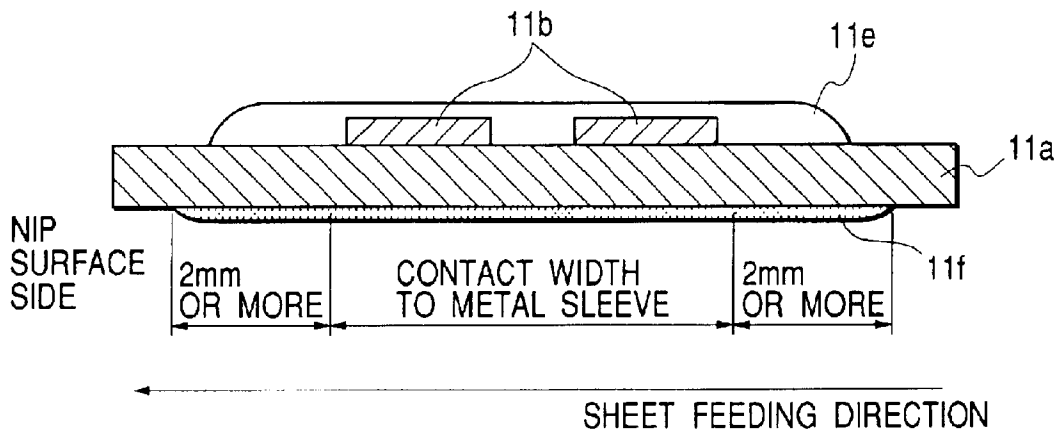

The heater shown in FIGS. 8A to 8C is a back-surface-heating-type heater the same as the heater shown in FIGS. 3A, 3B, and 3C. Numeral 11*f* denotes a slide layer mainly containing an imide-based resin such as polyimide or polyamide-imide formed on one face of a heater sliding with the inside of a metal sleeve 13. The slide layer has a function superior in heat resistance, lubricity, abrasion resistance and provides a smooth sliding characteristic with a metal sleeve. It is preferable to apply the slide layer only to a portion where the metal sleeve contacts with the heater face because the heat capacity of the whole heater increases and the heat conduction efficiency to the metal sleeve is deteriorated when applying the layer to an excessive area as an applying region.

The longitudinal both ends of the heater protrude beyond the opening of the metal sleeve and a power-supply connector (not shown) is connected to the protruding portion. Therefore, the protruding portion of the heater does not contact with the metal sleeve. Therefore, in the case of this embodiment, as sown in FIG. 8B, a slide layer made of an imide-based resin is formed in a region inside of the position at which a power-supply electrode 11*c* (portion combined with power-supply connector) at the longitudinal both ends of the heater and which can cover the bus-directional length of the metal sleeve. Actually, because there is a play (rotational deflection) of approx. 1 mm in the bus direction of the metal film when the metal film rotates and moreover there is a manufacturing tolerance of each member, it is enough to design the right and left of the bus-directional length of a metal film long by approx. 3 mm. Even when taking the above margin into account, it is preferable to form a slide layer only in a region excluding the longitudinal both-end regions of the heater in order to reduce the heat capacity of the heater.

Moreover, it is enough for the lateral direction (width direction) of the heater to cover the contact portion between the metal film and the heater as shown in FIG. 8C. However, the contact width with the metal sleeve in the lateral direction of the heater has a solid difference because of fluctuation of the rubber hardness of a pressure roller 20, deterioration of the rubber hardness due to a durability test, and heater setting error (shift in the sheet feeding direction). Therefore, it is preferable to make a design by considering the solid difference and providing a margin of approx. 2 mm or more for the upstream and downstream directions of the contact width. Even when taking the above margin into account, it is preferable to form a slide layer only in the region excluding the lateral end region of the heater in order to reduce the heat capacity of the heater.

As described above, by forming a slide layer made of an imide-based resin in the region excluding the longitudinal and lateral end regions of a heater substrate, it is possible to minimize the heat capacity of a heater. Moreover, it is possible to secure the electrically insulating characteristic and improve the sliding characteristic with a metal sleeve.

Others

1) A heating-fixing apparatus is effective for both oil-based fixing and oilless-based fixing.
2) It is allowed that a heating heater uses an electromagnetic-induction exothermic member.
3) A heating-fixing apparatus of the present invention includes an image heating apparatus for temporarily fixing an image on a recording material and an image heating apparatus for reforming the top-surface property such as luster.

The present invention is not restricted to the above embodiments but it includes modifications within the scope of the invention.

What is claimed is:

1. An image heating apparatus comprising:

a heater for heating an image on a recording material, the heater having a substrate and a heat generating resistor formed on a first plane of said substrate; and a rotator for rotating in contacting with a second plane opposite to the first plane of said heater, which has a metallic layer, wherein a slide layer made of an imide-based resin is formed by coating or screen printing on a surface contacting to an internal surface of said rotator;

and wherein a thickness of said slide layer is greater than or equal to 3 $\mu$m and less than or equal to 10 $\mu$m.

2. An image heating apparatus according to claim 1, wherein said substrate is constituted by an electrically insulating material and said slide layer is directly formed on said substrate.

3. An image heating apparatus according to claim 2, wherein said substrate is made of ceramic.

4. An image heating apparatus according to claim 1, wherein said substrate is constituted by a conductive material and said slide layer is formed on said substrate through an electrically insulating layer.

5. An image heating apparatus according to claim 4, wherein said substrate is made of a metal.

6. An image heating apparatus according to claim 1, wherein said slide layer is formed in the region excluding the longitudinal end region of said substrate.

7. An image heating apparatus according to claim 6, wherein a power-supply electrode to said heat generating resistor is formed in the longitudinal end region.

8. An image heating apparatus according to claim 1, wherein said slide layer is formed in the region excluding the lateral end region of said substrate.

9. A heater comprising:

a substrate;

a heat generating resistor; and a top-surface layer formed on said substrate wherein said top-surface layer is an imide-based resin formed on said substrate by coating or screen printing on a surface; and wherein a thickness of said top-surface layer is greater than or equal to 3 $\mu$m and less than or equal to 10 $\mu$m.

10. A heater according to claim 9, wherein said substrate is constituted by an electrically insulating material and said top-surface layer is directly formed on said substrate.

11. A heater according to claim 10, wherein said substrate is made of ceramic.

12. A heater according to claim 9, wherein said substrate is constituted by a conductive material and said top-surface layer is formed on said substrate through an electrically insulating layer.

13. A heater according to claim 12, wherein said substrate is made of a metal.

14. A heater according to claim 9, wherein said surface layer is formed in a region excluding the longitudinal end region of said substrate.

15. A heater according to claim 14, wherein a power-supply electrode to said sheet generating resistor is formed in a longitudinal end region.

16. A heater according to claim 9, wherein said top-surface layer is formed in a region excluding the lateral end region of said substrate.

17. An image heating apparatus comprising:

a heater for heating an image on a recording material, the heater having a substrate and a heat generating resistor formed to said substrate;

a rotator for rotating in contacting with the face of the side on which said heat generating resistor of said heater is formed, which has a metallic layer, wherein an electrically insulating layer is formed on said heat generating resistor and a slide layer made of an imide-based resin is formed on said electrically insulating layer.

18. An image heating apparatus according to claim 17, wherein said slide layer has a thickness greater than or equal to 3 and less than or equal to 10 $\mu$m.

19. An image heating apparatus according to claim 17, wherein said electrically insulating layer has a thickness greater than or equal to 30 less than or equal to 100 $\mu$m.

20. An image heating apparatus according to claim 17, wherein said electrically insulating layer is a glass layer.

21. An image heating apparatus according to claim 17, wherein said substrate is constituted by an electrically insulating material and said heat generating resistor is directly formed on said substrate.

22. An image heating apparatus according to claim 21, wherein said substrate is made of ceramic.

23. An image heating apparatus according to claim 17, wherein said substrate is constituted by a conductive material and said heat generating resistor is formed on said substrate through an electrically insulating layer different from the electrically insulating layer.

24. An image heating apparatus according to claim 23, wherein said substrate is made of a metal.

25. An image heating apparatus according to claim 17, wherein said slide layer is formed in a region excluding a longitudinal end region of said substrate.

26. An image heating apparatus according to claim 25, wherein a power-supply electrode to said heat generating resistor is formed in a longitudinal end region.

27. An image heating apparatus according to claim 17, wherein said slide layer is formed in a region excluding a lateral end region of said substrate.

28. A heater comprising:

a substrate;

a heat generating resistor;

an electrically insulating layer formed on said heat generating resistor; and a top-surface layer made of an imide-based resin formed on said electrical insulation layer.

29. A heater according to claim 28, wherein said surface layer has a thickness greater than or equal to 3 and less than or equal to 10 $\mu$m.

30. A heater according to claim 28, wherein said electrically insulating layer has a thickness greater than or equal to 30 and less than or equal to 100 $\mu$m.

31. A heater according to claim 28, wherein said electrically insulating layer is a glass layer.

32. A heater according to claim 28, wherein said substrate is constituted by an electrically insulating material and said heat generating resistor is directly formed on said substrate.

33. A heater according to claim 32, wherein said substrate is made of ceramic.

34. A heater according to claim 28, wherein said substrate is constituted by a conductive material and said heat generating resistor is formed on said substrate through an electrically insulating layer different from the electrically insulating layer.

35. A heater according to claim 34, wherein said substrate is made of a metal.

36. A heater according to claim 28, wherein said surface layer is formed in a region excluding a longitudinal end region of said substrate.

37. A heater according to claim 36, wherein a power-supply electrode to said heat generating resistor is formed in a longitudinal end region.

38. A heater according to claim 28, wherein said surface layer is formed in a region excluding the lateral end region of said substrate.

* * * * *

UNITED STATES PATENT AND TRADEMARK OFFICE

CERTIFICATE OF CORRECTION

PATENT NO. : 6,787,737 B2
DATED : September 7, 2004
INVENTOR(S) : Eiji Uekawa et al.

It is certified that error appears in the above-identified patent and that said Letters Patent is hereby corrected as shown below:

Drawings,
Sheet No. 2, Figure 3C, “BACKS” should read -- BACK --.

Column 1,
Lines 25 and 26, “has” should read -- have --.
Line 65, “to” should read -- to heat --.

Column 2,
Lines 45, 53 and 59, “further” should read -- a further --.

Column 3,
Line 1, “further” should read -- a further --.

Column 5,
Lines 64 and 67, “layer” should read -- layers --.

Column 6,
Line 3, “layer” should read -- layer. --; and “denotes” should read -- denote --.
Line 25, “with” should be deleted.
Line 50, “ranges” should read -- range --.

Column 7,
Line 22, “has” should read -- have --.
Lines 55 and 56, “is” should read -- be --.

Column 10,
Line 38, “insulting” should read -- insulating --.

Column 11,
Line 1, “fist” should read -- first --.
Line 6, “is” should read -- be --.
Lines 28 and 66, “uniform” should read -- make uniform --.

UNITED STATES PATENT AND TRADEMARK OFFICE

CERTIFICATE OF CORRECTION

PATENT NO. : 6,787,737 B2
DATED : September 7, 2004
INVENTOR(S) : Eiji Uekawa et al.

It is certified that error appears in the above-identified patent and that said Letters Patent is hereby corrected as shown below:

Column 12,
Line 2, “break” should read -- breakage --.
Line 28, “with” should be deleted.
Line 38, “sown” should read -- shown --.

Signed and Sealed this

Fourteenth Day of December, 2004

JON W. DUDAS
*Director of the United States Patent and Trademark Office*